United States Patent [19]

Stalder et al.

[11] Patent Number: 4,593,521

[45] Date of Patent: Jun. 10, 1986

[54] JET SPINNING DEVICE

[75] Inventors: Herbert Stalder, Vord; Emil Briner, Winterthur, both of Switzerland

[73] Assignee: Rieter Machine Works Limited, Winterthur, Switzerland

[21] Appl. No.: 538,678

[22] Filed: Oct. 3, 1983

[30] Foreign Application Priority Data

Oct. 29, 1982 [CH] Switzerland ..... 6311/82

[51] Int. Cl.[4] ..... D01H 5/28; D02G 1/16; B65H 51/16

[52] U.S. Cl. ..... 57/328; 28/254; 28/271; 57/333; 57/350; 57/352; 226/7; 226/97

[58] Field of Search ..... 57/328, 333, 350, 352; 28/271–276, 254–257; 226/7, 97

[56] References Cited

U.S. PATENT DOCUMENTS

| | | | |
|---|---|---|---|
| 3,094,262 | 6/1963 | Ashby et al. | 226/97 |
| 3,363,041 | 1/1968 | Shichman et al. | 28/271 X |
| 3,457,610 | 7/1969 | Williams et al. | 28/273 X |
| 3,490,219 | 1/1970 | Ozawa et al. | 57/328 |
| 3,710,460 | 1/1973 | Segraves | 28/271 |
| 3,976,237 | 8/1976 | Bossons | 226/97 |
| 4,041,586 | 8/1977 | Foster et al. | 28/271 X |
| 4,124,972 | 11/1978 | Arai | 57/328 |
| 4,173,861 | 11/1979 | Norris et al. | 57/293 |
| 4,457,130 | 7/1984 | Sakai et al. | 57/328 |
| 4,480,434 | 11/1984 | Hiroshi et al. | 57/350 X |

FOREIGN PATENT DOCUMENTS

| | | |
|---|---|---|
| 2722319 | 7/1978 | Fed. Rep. of Germany . |
| 2059474 | 4/1981 | United Kingdom . |

*Primary Examiner*—John Petrakes
*Attorney, Agent, or Firm*—Werner W. Kleeman

[57] ABSTRACT

In a jet spinning device, in order to enable automatic transport of the yarn from a twist jet to an output roller pair which, for spin-technological reasons, is somewhat spaced from the twist jet, the twist jet is placed in flow communication with a pneumatic guide tube projecting up to the output roller pair. In order to enable automatic threading of the yarn or the like into the output roller pair, the opening or mouth of the guide tube is arranged so close to the output roller pair that the yarn is conveyed into the converging space of the output roller pair and is engaged or entrained thereby.

11 Claims, 10 Drawing Figures

JET SPINNING DEVICE

BACKGROUND OF THE INVENTION

The present invention relates to a new and improved jet spinning device comprising a pneumatic twist jet or nozzle arranged downstream from a delivery roller pair for receiving an unspun yarn delivered by the delivery roller pair together with an output roller pair arranged downstream from the twist jet for receiving the spun yarn delivered by the twist jet.

When using the jet spinning method, and thus during the use of a jet spinning device, high spinning speeds are achieved, that is there are attained fiber travel speeds up to 200 m/min. This implies that, on the one hand, the delivery roller pair feeds the unspun yarn at the aforementioned speed into the twist jet which, on the other hand, passes on the spun yarn at substantially the same speed.

From German Published Patent No. 2,722,319 there is known a jet spinning device (referred to in this patent as "device for pneumatic false twist spinning") in which a yarn can be spun with the aforementioned speed.

As in other spinning methods, the yarn also occasionally breaks when using the jet spinning method. Such yarn rupture is detected by an automatic monitoring system which does not form part of this invention, and as a result the fiber sliver feed is interrupted by the same automatic system.

Having regard to these facts, the device disclosed in the aforementioned German Published Patent No. 2,722,319 and similar devices have the disadvantage that an automatic system for dealing with and eliminating such a yarn or thread break only can be provided in a very poor form or with considerable complications and therefore expense. This is the case because the yarn delivered at a high speed from the twist jet must be taken-up by a movable suction element at the exit opening or mouth of the twist jet and must be guided between output rollers, which are automatically separable and reclosable and are arranged at a spacing corresponding to the spinning process, the yarn thereafter being transferred to a wind-up device. This disadvantage also applies, even if to a lesser extent, to the same procedure when carried out manually.

SUMMARY OF THE INVENTION

It is therefore a primary object of this invention to eliminate this disadvantage.

Another important object of the present invention is directed to an improved construction of jet spinning device which facilitates the self-threading of the yarn into the pair of output rollers.

Yet a further important object of the present invention is directed to a new and improved construction of jet spinning device which renders easier the handling of yarn breakage.

A further noteworthy object of the present invention is concerned with a jet spinning device which is structured such that there is afforded quieter operation, while facilitating the threading of the yarn into a pair of output rollers arranged in spaced relationship from and downstream of the twist jet or nozzle.

Now in order to implement these and still further objects of the invention, which will become more readily apparent as the description proceeds, the jet spinning device of the present development is manifested by the features that a pneumatic guide tube communicates with the twist jet or nozzle and projects so close to the output roller pair that the yarn is forwarded into the converging space of the output roller pair, and thus, is automatically received and forwarded by the output roller pair.

Some of the more notable advantages of the invention are to be seen in that, on the one hand, the self-threading of the yarn into the output roller pair is achieved in the simplest manner and, on the other hand, in the event that an automatic system is provided for dealing with yarn or thread breaks only the simple transfer of the yarn from the output rollers or rolls to the wind-up device must be automated.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various embodiments depicted in the drawings there have been generally used the same reference characters to denote the same or analogous elements, and wherein.

DETAILED DESCRIPTION OF THE PREFERRED EMBODIMENTS

Figure 1:
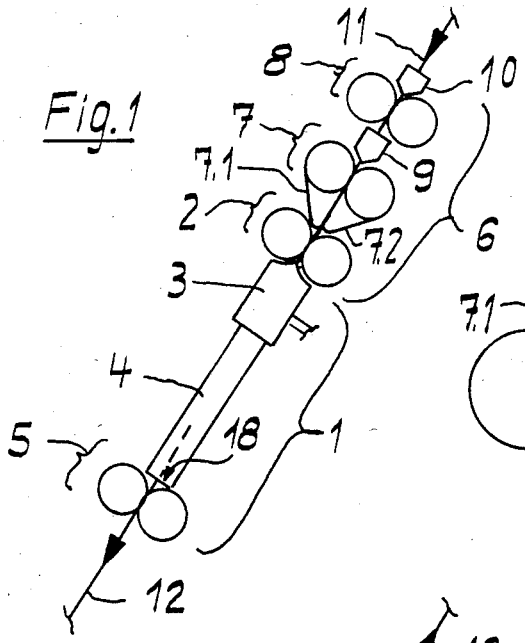
FIG. 1 shows a schematic representation of a jet spinning device in combination with a preceding or upstream located two-zone drafting arrangement or mechanism, the combination making up a so-called "downward spinning system"

Describing now the drawings, it is to be understood that only enough of the construction of the jet spinning device has been shown in the drawings as needed for those skilled in the art to readily understand the underlying principles and concepts of the present development, while simplifying the illustration of the drawings. Turning attention now specifically to the jet spinning devices 1 shown in FIGS. 1 and 2, each such jet spinning device 1 will be seen to comprise a pneumatic twist jet or nozzle 3 arranged following a delivery roller pair 2 and with an immediately thereat flow communicating pneumatic guide tube or pipe 4 which opens towards an output or exit roller pair 5.

The term "pneumatic guide tube", as employed herein, refers to a tube or the like which guides an air stream or flow under normal aerodynamic conditions, that is to say, without sudden changes in cross-section and with a roughness normal for pneumatic guide tubes for fibers.

The jet spinning device 1 is arranged downstream from a suitable drafting arrangement or mechanism 6 which does not form part of the invention and which comprises the delivery roller pair 2. This drafting mechanism 6 also comprises an intermediate roller pair 7 provided with guide aprons 7.1 and 7.2, an infeed roller pair 8 provided with a first fiber sliver condensor 10 arranged before or upstream of the infeed roller pair 8, and a second fiber sliver condensor 9 arranged between the intermediate roller pair 7 and the infeed roller pair 8. The drafting mechanism 6 takes-up a fiber sliver 11 or the like which passes into the drafting mechanism 6 in the direction of the not particularly referenced arrow and which is drawn or drafted into a still unspun yarn which is delivered by the delivery roller pair 2 and automatically received and forwarded by the pneumatic twist jet or nozzle 3. The term fiber sliver 11 as used herein is intended to encompass a sliver from a drawing frame or roving from a roving frame or a plurality of combined rovings.

In the twist jet 3, this unspun yarn is spun to a finished yarn 12 received and forwarded by output roller pair 5. The yarn 12 leaves the output roller pair 5 in the direction of the not particularly referenced arrow and is thereafter taken-up by a conventional wind-up device (not shown).

Instead of the illustrated drafting mechanism 6 another drafting mechanism or arrangement can be used which is capable of delivering an unspun yarn with the same speed.

The twist jet 3 is basically known from the aforementioned German Published Patent No. 2,722,319, to which reference may be readily had and the disclosure of which is incorporated herein by reference. This twist jet 3 is additionally provided with a substantially cylindrical surface 14 and an abutment or stop 15 for receiving a sleeve or collar 13 provided on the pneumatic guide tube 4. Mounting of the pneumatic guide tube 4 on the twist jet or nozzle 3 then can be conveniently effected by a clamping ring or equivalent structure (not shown) encircling both parts. As a variation, in place of the cylindrical surface 14, a screw thread (not shown) can be provided for mounting the pneumatic guide tube 4 on the twist jet 3. This mounting is not, as such, essential to the invention and any suitable mounting arrangement can be employed.

The pneumatic guide tube 4 has an internal wall 16 which at the connection or interface 17 with the exit or outlet channel C of the twist jet or nozzle 3 has the same diameter as such exit or outlet channel C.

Instead of being composed of two parts, the twist jet 3 and the pneumatic guide tube 4 can be made in one piece or the pneumatic guide tube 4 can be made up of a plurality of parts.

The exit or outlet opening 18 of the pneumatic guide tube 4 projects so close to the output or exit roller pair 5 that the yarn 12 is forwarded into the converging space 19 of the output roller pair 5 and is thus entrained by the latter.

The sum of all spacing gaps or spaces between the rim or mouth edge 20 of the exit or outlet opening 18 and the cylindrical surface of the output roller pair 5, defining an air exit or outlet cross-section between this rim 20 and said cylindrical surface, must not be substantially smaller than the opening or mouth cross-section measured normal to the direction of flow and as will be more fully defined later in this disclosure. This condition applies to all modifications still to be described.

In order to achieve a substantially uniform air exit or outlet cross-section the exit or outlet opening 18 is formed in a manner adapted to the cylindrical surface of the output or exit roller pair 5, as shown in FIGS. 4, 6, 7 and 8, as variants 18.1, 18.3, 18.4 and 18.5 projecting partly into the converging space or region 19.

In FIGS. 5 to 9 the variants 18.2, 18.3, 18.4 and 18.5 respectively also show how the exit or outlet opening 18 is arranged relative to an exit or output roller pair 5 disposed at an inclination to the direction of flow.

Figure 3:
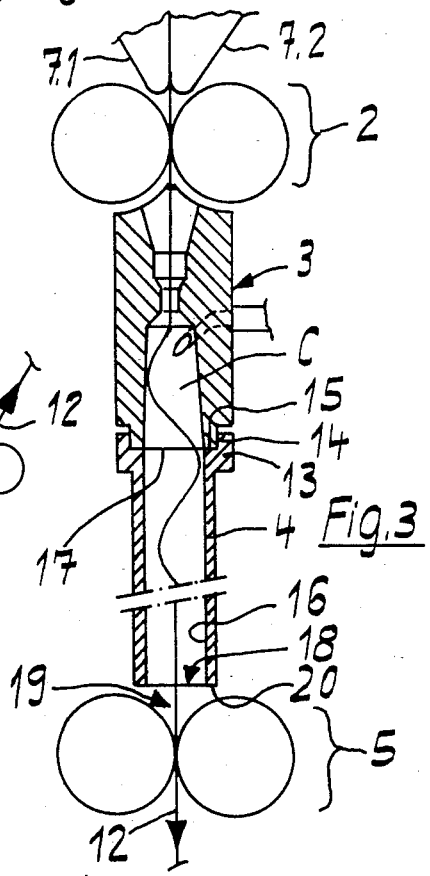
FIG. 3 shows the jet spinning device of FIG. 1 or FIG. 2 on an enlarged scale and part-schematically illustrated.
Figure 4:
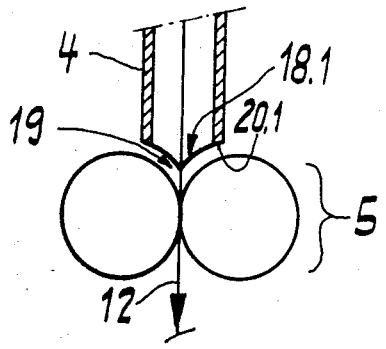
FIGS. 4 to 9 show respective details of the jet spinning device of FIG. 3, but each showing a respective different embodiment, represented to the same scale.
Figure 7:
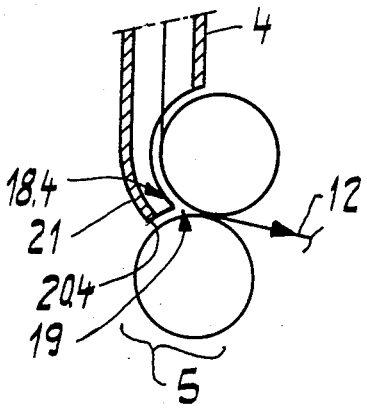
Figure 5:
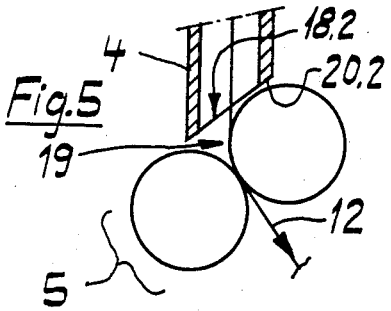
Figure 8:
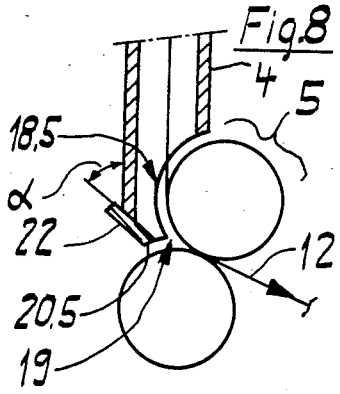
Figure 6:
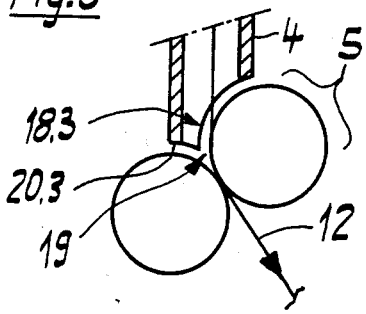
Figure 9:
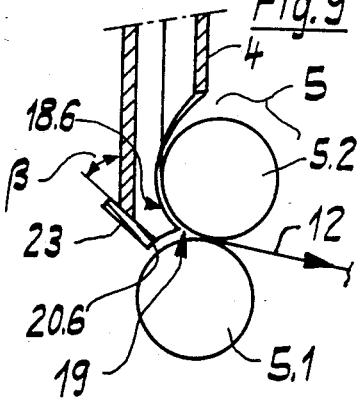

In these variants, the rim 20 of the arrangement of FIG. 3 is changed in FIG. 4 to the rim 20.1, in FIG. 5 to the rim 20.2, in FIG. 6 to the rim 20.3, in FIG. 7 to the rim 20.4, in FIG. 8 to the rim 20.5, and in FIG. 9 to the rim 20.6.

The arrangement of the pneumatic guide tube 4 must be such that its axis of symmetry (not shown) coincides with the yarn or thread path in the region of the exit or outlet opening.

The rims 20 to 20.6 define those surfaces which face the two cylindrical surfaces of the output or exit roller pair 5 and are formed by the periphery of the exit our outlet opening.

In relation to each variant, the term "air exit or outlet cross-section" refers to the respective surface or area which is constituted by the sum of all the shortest distances between the rim and the oppositely situated cylindrical surfaces of the output roller pair 5.

In FIGS. 3 and 5 the exit or outlet opening 18 or 18.2 is so arranged that the rim 20 or 20.2, respectively, lies in a plane which is substantially parallel to an imaginary plane containing the axes of the output or exit rollers 5.

FIGS. 7 to 9 also show respective outlet or exit openings 18.4, 18.5 and 18.6 with a flow diversion directed towards the output or exit roller pair 5.

In FIG. 7, the outlet opening 18.4 has an elbow or curved portion 21, in FIG. 8 the outlet opening 18.5 has a divertor portion 22, and in FIG. 9 the outlet opening 18.6 has a divertor portion 23. The elbow portion 21 and the divertor parts or portions 22 and 23 assist the diversion of the air flow and of the yarn during threading into the converging space or region 19.

The elbow portion 21 is formed by bending of the pneumatic guide tube 4 in the opening or mouth region shown in FIG. 7. The divertor parts or portions 22 and 23 are constituted by substantially flat sheet parts which, as shown in FIGS. 8 and 9 respectively, are secured at respective angles of inclination $\alpha$ and $\beta$ to a surface milled or otherwise appropriately machined in the opening region of the outlet or exit opening 18.5 and 18.6, respectively.

The degree of bend or curvature of the elbow or curved portion 21 and the values of the angles of inclination $\alpha$ and $\beta$, respectively, depend upon the inclination of the output or exit roller pair 5 with respect to the pneumatic guide tube 4 and upon the speed of the air flow, and they are determined empirically in practice.

FIG. 9 shows another arrangement which influences the direction of flow and in which the spacing between the lowest part of the rim 20.6 and the output roller pair 5, that is to say, the spacing in relation to the lower roller 5.1, is smallest and increasingly widens towards the upper region of the rim 20.6. By this arrangement, the air exit or outlet in the lowest region of the rim 20.6 can be arranged such that the yarn 12 with certainty is not transported over the rim 20.6 past the lower output roller 5.1 into the free space or ambient surroundings, but is forwarded or transported into the converging space or region 19.

The quantity of air flowing through the pneumatic guide tube 4 corresponds to the quantity of air delivered by the twist jet or nozzle 3.

At the start of the spinning process, that is during suction of the unspun yarn by the twist jet or nozzle 3 and the subsequent spinning and further transport by means of the air quantity required by the twist jet 3, the free end of the yarn 12 is guided by the pneumatic guide tube 4 towards and into the converging space 19, so that it is caught by the output roller pair 5.

For reasons of flow technology, the pneumatic guide tube 4 can be provided with a cone (not shown) widening towards the output roller pair 5. This cone can have the same apex or aperture angle (not shown) over the whole length of the pneumatic guide tube. Even if the pneumatic guide tube does not have a cone over its complete length, the apex or aperture angle should still not substantially exceed the apex or aperture angle of the outlet or exit channel C.

The aforementioned term "opening or mouth cross-section" refers to that internal cross-section of the pneumatic guide tube 4 which is still present as a complete section in the opening region of the pneumatic guide tube. In FIG. 3 this is, for example, the cross-section of the outlet or exit opening 18 itself, while in the other figures it is that complete section which immediately follows the inclined or beveled opening 18.2 (FIG. 5), or the profiled opening 18.1, 18.3, 18.4, 18.5 or 18.6, respectively, (FIGS. 4 and 6 to 9).

An advantage of this construction of the pneumatic guide tube (which is favorable for flow technological grounds) lies in the possibility of damping the noise which arises upon departure of the air.

Figure 2:
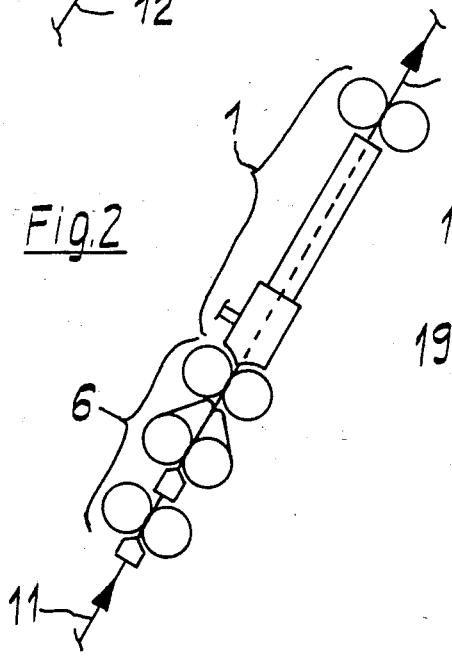
FIG. 2 shows the combination of FIG. 1, but this time illustrated as a so-called "upward spinning system"

FIG. 2 shows that the jet spinning device can also be used with the spinning direction upwardly arranged. The elements in this variant construction are therefore generally indicated with the same reference numerals as used for the embodiment of FIG. 1.

Figure 10:
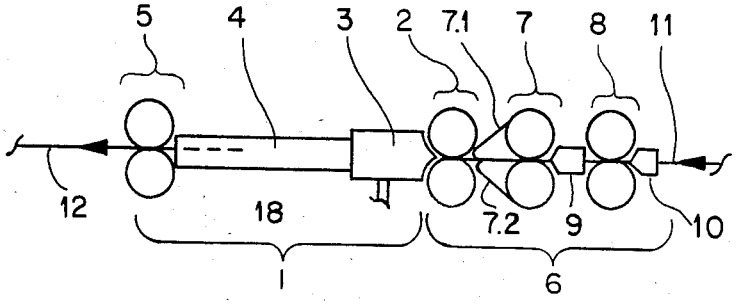
FIG. 10 shows the combination of FIG. 1, but arranged as a so-called "horizontal spinning system".

FIG. 10 shows that the jet spinning device can also be used with the spinning direction substantially horizontally arranged. The elements in this variant construction are therefore generally indicated with the same reference numerals as used for the embodiment of FIG. 1.

While there are shown and described present preferred embodiments of the invention, it is to be distinctly understood that the invention is not limited thereto, but may be otherwise variously embodied and practiced within the scope of the following claims. Accordingly,

What we claim is:

1. A jet spinning device comprising:

a delivery roller pair;

a pneumatic twist jet arranged after said delivery roller pair for receiving and forwarding an unspun yarn delivered by the delivery roller pair;

an output roller pair arranged after the twist jet for receiving and forwarding a spun yarn delivered by the twist jet;

said output roller pair defining a converging space;

a pneumatic guide tube operatively associated with the twist jet;

said pneumatic guide tube projecting sufficiently close to the output roller pair such that the spun yarn is forwarded into the converging space of the output roller pair and is thereby automatically entrained by the output roller pair;

said pneumatic guide tube possessing a rim bounding an outlet opening; and said pneumatic guide tube together with said outlet opening thereof projecting sufficiently close to the output roller pair such that an air outlet cross-section defined between said rim of said outlet opening and a cylindrical surface of the output roller pair is not substantially smaller than an opening cross-section of the pneumatic guide tube and which opening cross-section is measured normal to the direction of flow of air through said pneumatic guide tube.

2. The jet spinning device as defined in claim 1, wherein:

said outlet opening is arranged such that said rim substantially lies in an imaginary plane.

3. The jet spinning device as defined in claim 1, wherein:

said outlet opening projects partly into said converging space and is substantially adapted to the cylindrical surface of the output roller pair.

4. The jet spinning device as defined in claim 3, wherein:

said outlet opening is arranged such that said rim substantially lies in an imaginary plane; and the outlet opening being adapted to the position of the output roller pair.

5. The jet spinning device as defined in claim 4, wherein:

said rim and said cylindrical surface of said output roller pair defines therebetween a space forming said air outlet cross-section; and said space is of substantially constant size.

6. The jet spinning device as defined in claim 4, wherein:

said rim and said cylindrical surface of said output roller pair defines therebetween a space forming said air outlet cross-section; and said rim is structured such that said space is variable.

7. The jet spinning device as defined in claim 6, wherein:

said outlet roller pair comprises output rollers, each having an axis of rotation; and the rim of the outlet opening lies in a plane which is substantially parallel to an imaginary plane containing the axes of rotation of said output rollers.

8. The jet spinning device as defined in claim 6, wherein:

said space is smaller at the region of a roller of the output roller pair lying closer to an outer end of the outlet opening than at the region of a roller of the output roller pair lying further from the outer end of the outlet opening.

9. The jet spinning device as defined in claim 1, further including:

means cooperating with said jet spinning device to define a downward spinning system.

10. The jet spinning device as defined in claim 1 further including:

means cooperating with said jet spinning device to define an upward spinning system.

11. The jet spinning device as defined in claim 1 further including:

means cooperating with said jet spinning device to define a substantially horizontal spinning system.

* * * * *